US010604963B2

(12) United States Patent
Moon

(10) Patent No.: US 10,604,963 B2
(45) Date of Patent: Mar. 31, 2020

(54) MOTORIZED LOCK AND TRIM ASSEMBLY

(71) Applicant: TOWNSTEEL, INC., City of Industry, CA (US)

(72) Inventor: Charles W. Moon, Colorado Springs, CO (US)

(73) Assignee: Townsteel, Inc., City of Industry, CA (US)

( * ) Notice: Subject to any disclaimer, the term of this patent is extended or adjusted under 35 U.S.C. 154(b) by 738 days.

(21) Appl. No.: 15/047,540

(22) Filed: Feb. 18, 2016

(65) Prior Publication Data

US 2016/0298360 A1 Oct. 13, 2016

Related U.S. Application Data

(60) Provisional application No. 62/145,455, filed on Apr. 9, 2015, provisional application No. 62/145,460, filed on Apr. 9, 2015.

(51) Int. Cl.

| | |
|---|---|
| ***E05B 13/00*** | (2006.01) |
| ***E05B 15/02*** | (2006.01) |
| ***E05B 15/04*** | (2006.01) |
| ***E05B 47/06*** | (2006.01) |
| *E05B 47/00* | (2006.01) |

(52) U.S. Cl.

CPC ..... *E05B 13/004* (2013.01); *E05B 15/02* (2013.01); *E05B 15/04* (2013.01); *E05B 47/0692* (2013.01); *E05B 47/0012* (2013.01); *E05B 2015/0448* (2013.01); *E05B 2047/0031* (2013.01); *Y10T 292/1021* (2015.04)

(58) Field of Classification Search

CPC ..... E05B 13/004; E05B 15/02; E05B 15/04; E05B 47/0012; Y10T 292/1021

See application file for complete search history.

(56) References Cited

U.S. PATENT DOCUMENTS 1,833,572 A * 11/1931 Hardesty ..... E05B 77/48 180/289
4,995,248 A * 2/1991 Liu ..... E05B 47/0692 70/107
5,409,278 A * 4/1995 Harcourt ..... E05B 3/06 292/348

(Continued)

*Primary Examiner* — Carlos Lugo
(74) *Attorney, Agent, or Firm* — Eric W. Cernyar; Huffman Law Group, PC

(57) ABSTRACT

A lock trim assembly incorporates an escapement assembly comprising a control member and an escapement spring. The escapement assembly is movable between a locking position that blocks rotation of the spindle and an unlocking position that does not block rotation of the spindle. A coupling assembly that couples the handle to the spindle rotates between a default orientation and a blocking orientation. The default orientation allows the escapement assembly to move into the locking position. The blocking orientation blocks the escapement assembly from moving into the locking position. When the coupling assembly is in the blocking orientation, operation of the motor to drive the blocked escapement assembly into the locking position causes the escapement assembly to store energy in the escapement spring for forcing the escapement assembly into the locking position once the coupling assembly is reoriented back to the default orientation.

16 Claims, 19 Drawing Sheets

(56) References Cited

U.S. PATENT DOCUMENTS 5,487,289 A * 1/1996 Otto, III ..... E05B 47/0002 292/150
5,640,863 A 6/1997 Frolov
5,658,026 A * 8/1997 Nigro, Jr. ..... E05B 13/002 292/336.3
5,857,365 A 1/1999 Armstrong
5,881,586 A * 3/1999 Shen ..... E05B 53/00 292/34
6,012,310 A 1/2000 Hsiao
6,053,019 A * 4/2000 Wiik ..... E05B 47/0673 70/283
6,062,612 A 5/2000 Lin
6,216,502 B1 4/2001 Cannella et al.
6,363,762 B1 * 4/2002 Kueng ..... E05B 47/063 70/278.3
6,406,072 B1 6/2002 Chen
6,425,613 B1 * 7/2002 Shen ..... E05B 15/02 292/348
6,471,257 B1 10/2002 Lu et al.
6,487,884 B1 12/2002 Constantinou
6,517,127 B1 2/2003 Lu et al.
6,591,643 B1 7/2003 Cannella et al.
6,598,909 B2 7/2003 Lu
6,619,710 B1 * 9/2003 Hwang ..... E05B 63/006 292/336.3
6,725,693 B2 4/2004 Yu et al.
6,851,291 B2 2/2005 Nunez
6,895,791 B2 5/2005 Alexander et al.
7,007,526 B2 3/2006 Frolov et al.
7,051,561 B2 5/2006 Moon et al.
7,066,507 B2 * 6/2006 Don ..... E05B 9/08 292/169
7,096,698 B2 8/2006 Walsh, III et al.
7,188,495 B2 3/2007 Errani et al.
7,308,810 B2 12/2007 Menta San Miguel
8,201,858 B1 6/2012 Moon et al.
8,292,336 B2 10/2012 Moon
8,419,086 B2 4/2013 Moon
8,424,935 B2 4/2013 Moon
8,621,900 B2 1/2014 Wu et al.
8,783,076 B2 7/2014 Schwenk et al.
8,844,330 B2 9/2014 Moon et al.
9,033,375 B1 5/2015 Moon et al.
9,394,722 B2 7/2016 Moon et al.
9,528,300 B2 12/2016 Moon et al.
2001/0005998 A1 7/2001 Imedio Ocana
2004/0040353 A1 3/2004 Yu et al.
2006/0112747 A1 6/2006 Moon et al.
2011/0079057 A1 4/2011 Frolov et al.
2014/0250956 A1 9/2014 Chong
2016/0094103 A1 3/2016 Lien

* cited by examiner

MOTORIZED LOCK AND TRIM ASSEMBLY

RELATED APPLICATIONS

This application claims the benefit of U.S. Provisional Patent App. Nos. 62/145,455 and 62/145,460, both filed Apr. 9, 2015, which are herein incorporated by reference for all purposes.

FIELD OF THE INVENTION

This invention relates generally to door latching assemblies, and more particularly, to door latching assemblies that use a motorized lock mechanism to lock a door handle and prevent it from rotating.

BACKGROUND

There are many factors and constraints that influence designs of lock and trim assemblies, including the number of lock functions supported, the strength of the lock, the ability of the lock to thwart an attack, and the cost of manufacture. Each design constraint compounds the complexity of such a design, because attempting to accommodate a given design constraint may restrict one's ability to accommodate a different design constraint. Because not all designs are equally effective or practical, and because changing circumstances continually give rise to new design constraints, there is always a need for innovation.

For example, lock and trim assemblies that utilize a door lever commonly engage the spindle directly to the door handle, relying on a stop mechanism to prevent the lever and spindle from rotating. In many such assemblies, it is possible to defeat the stop mechanism by applying a crowbar or long wrench to the lever, shearing off components of the stop mechanism. Therefore, it is advantageous for a lock and trim assembly to be designed in a manner that thwarts such an attack.

As another example, many lock mechanisms require a door handle to be in a neutral, non-latch-retracting position in order to lock the handle. It is therefore advantageous for the trim assembly to incorporate a return spring to bias the handle back to the neutral position and an escapement spring to engage the lock when the handle returns to the neutral position.

Moreover, when choosing a replacement trim assembly for a door, it is important to find a trim assembly that is compatible with the spindle and possibly other elements of the interior latching assembly, that matches the door function (e.g., is it an interior door or an exit door), that is compatible with the handedness of the door, that matches the physical dimensions and relative placement of the mortise and/or bore cylinder, and that matches the physical arrangement of trim mounting holes.

Most trim assemblies, however, are only suitable for a specific type or make of lock. It would be advantageous to have a universal trim assembly that, with minimal substitution or rearrangement of parts, accommodates a wide variety of types and makes of locks, as well as a wide variety of lock functions. However, the design of such an assembly is complicated by the typically tight spacing of trim assembly components. For example, a rearrangement of the trim mounting posts may require a rearrangement of other trim assembly components.

The present invention described below can be characterized in many different ways, not all of which are limited by its capacity to address the above-mentioned issues, needs or design constraints.

SUMMARY

The present invention is directed to a lock trim assembly that incorporates an electric motor and an escapement assembly to operate a lock. The door trim assembly comprises a driver assembly operated by the motor, an escapement assembly, comprising a control member and an escapement spring, operated by the driver assembly, and a coupling assembly for coupling a door handle to a latch-retracting spindle. The escapement assembly is movable between a locking position that blocks rotation of the spindle and an unlocking position that does not block rotation of the spindle. The coupling assembly alternates between a default orientation and a blocking orientation, wherein the default orientation allows the escapement assembly to move into the locking position and the blocking orientation blocks the escapement assembly from moving into the locking position. When the coupling assembly is in the default orientation, the motor is operable to move the escapement assembly between the unlocking position and the locking position. When the coupling assembly is in the blocking orientation, operation of the motor to drive the blocked escapement assembly into the locking position causes the escapement assembly to store energy in the escapement spring for forcing the escapement assembly into the locking position once the coupling assembly is reoriented back to the default orientation.

The lock trim assembly also preferably incorporates a handle-to-spindle coupling assembly designed to thwart a torque attack on a door lever. Furthermore, the motor and escapement assembly are preferably arranged in a trim assembly that is adaptable to a variety of different doors, latching assemblies, and trim preparations.

These and other aspects and advantages of the embodiments disclosed herein will become apparent in connection with the drawings and detailed disclosure that follows.

Figure 1:
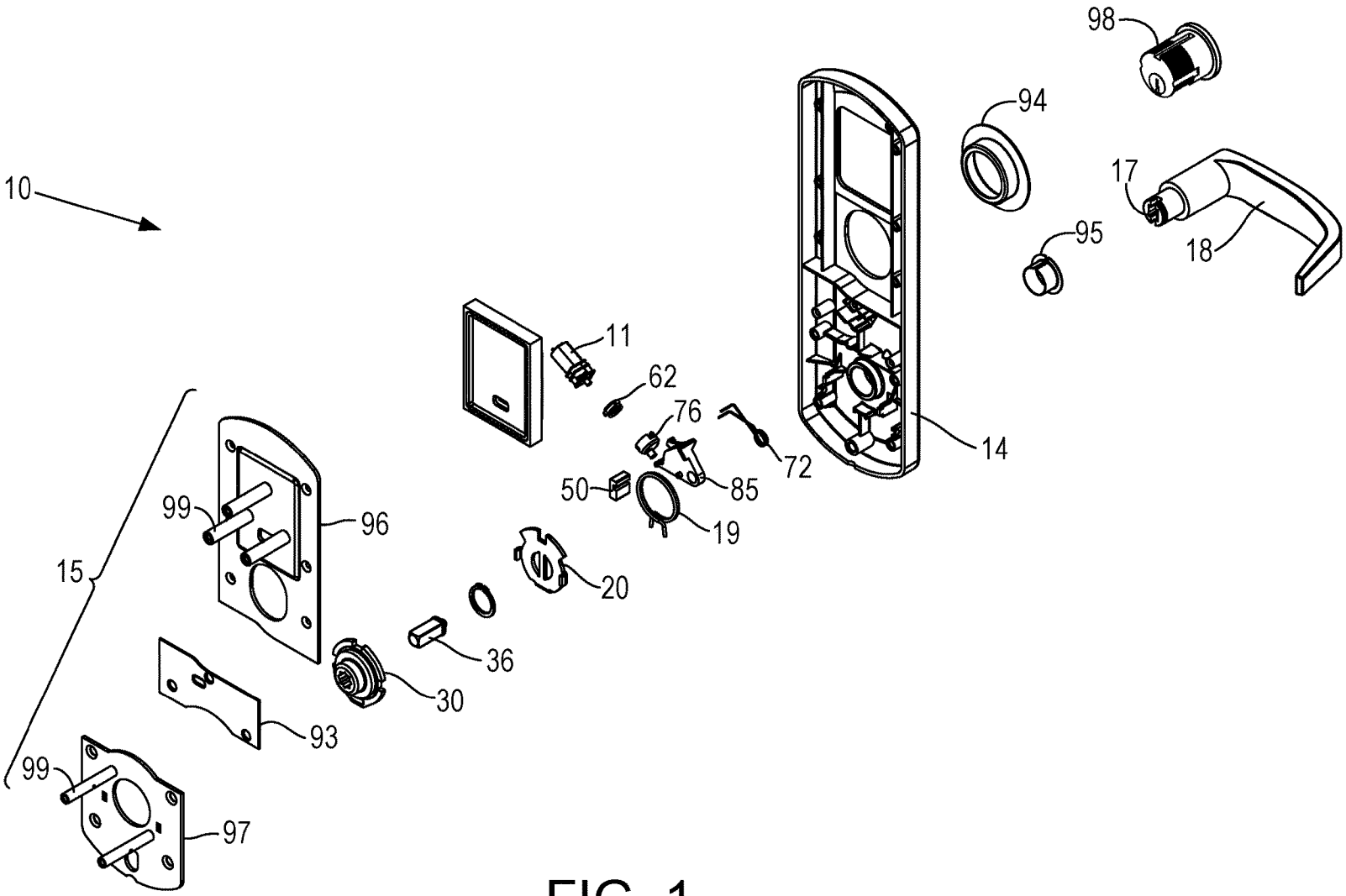
FIG. 1 is an exploded view diagram of one embodiment of a trim assembly according to the present invention.

These and other aspects and advantages of the embodiments disclosed herein will become apparent in connection with the drawings and detailed disclosure that follows.

DETAILED DESCRIPTION

FIGS. 1-21 illustrate various embodiments of a trim assembly 10. In describing preferred and alternate embodiments of the technology described herein, as illustrated in FIGS. 1-21, specific terminology is employed for the sake of clarity. The invention is not intended to be limited to the specific terminology so selected, but rather to be construed liberally in the context of this specification. The invention described herein, moreover, should be understood to incorporate all technical equivalents that operate in a similar manner to accomplish similar functions.

The trim assembly 10 comprises a coupling assembly 25—for example, a handle coupler 20 and spindle driver 30—that transfers load from a door handle 18 to a spindle 36. The trim assembly 10 also comprises a return spring 19 and a stopper or locking dog 50 operative to selectively lock the coupling assembly 25, preventing it from rotating to retract the door latch (not shown). The trim assembly 10 also comprises a motor 11, a transmission or driver assembly 60, and an escapement assembly 70 that together operate the stopper 50. The spindle 36 extends into a door cavity that houses a latch assembly (not shown), for example, a cylindrical assembly or a mortise assembly. Rotation of the spindle 36 is operative to retract the latch (not shown).

The trim assembly 10 also comprises an escutcheon 14 and a back plate assembly 15 that is mounted to the face of the door. The motor 11, driver assembly 60, escapement assembly 70, handle coupler 20, and most of the spindle driver 30 are contained between the escutcheon 14 and the back plate assembly 15. The handle coupler 20 is configured to be coupled to and rotated with a door handle/lever 18. A return spring 19 biases the handle 18 toward a neutral, non-latch retracting orientation. In one embodiment, the handle 18 can be operated in either direction from the neutral, non-latch retracting orientation to retract the latch. The trim assembly 10 may also provide collars or flanged parts 94 and 95 to adapt the trim assembly 10 to particular door widths.

Figure 3:
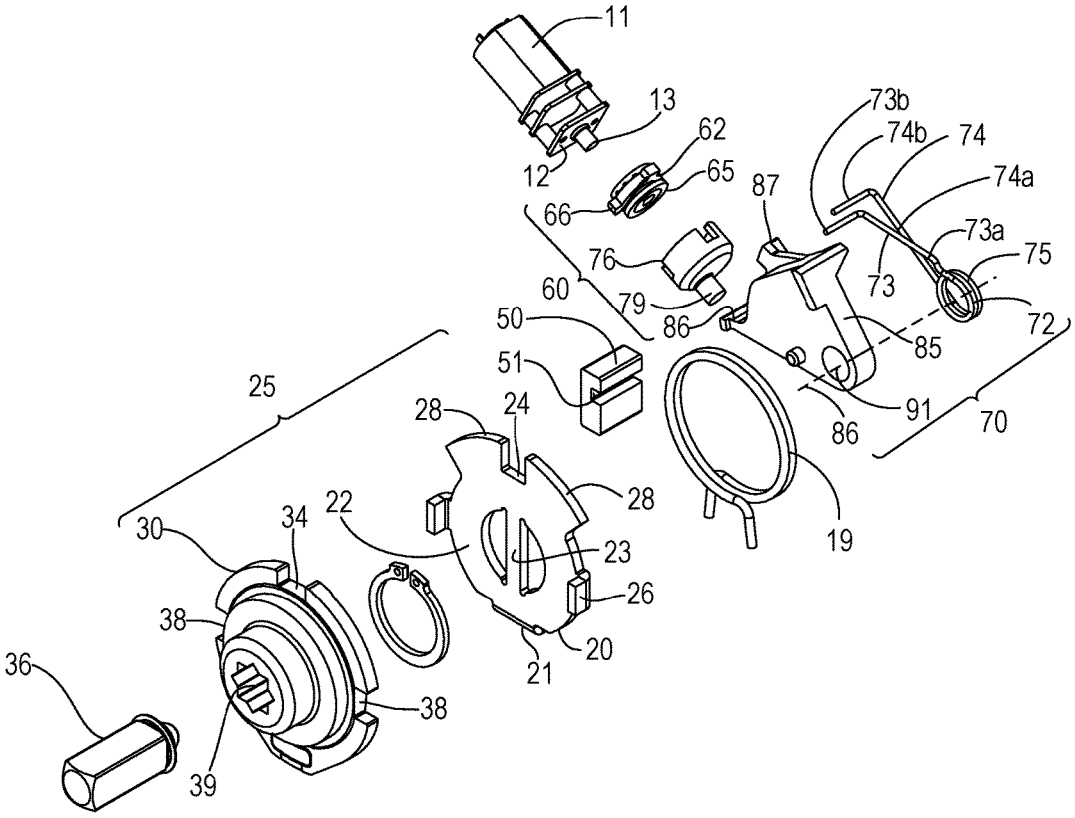
FIG. 3 is an exploded view diagram of the motorized lock and escapement mechanism of FIG. 1.
Figure 4:
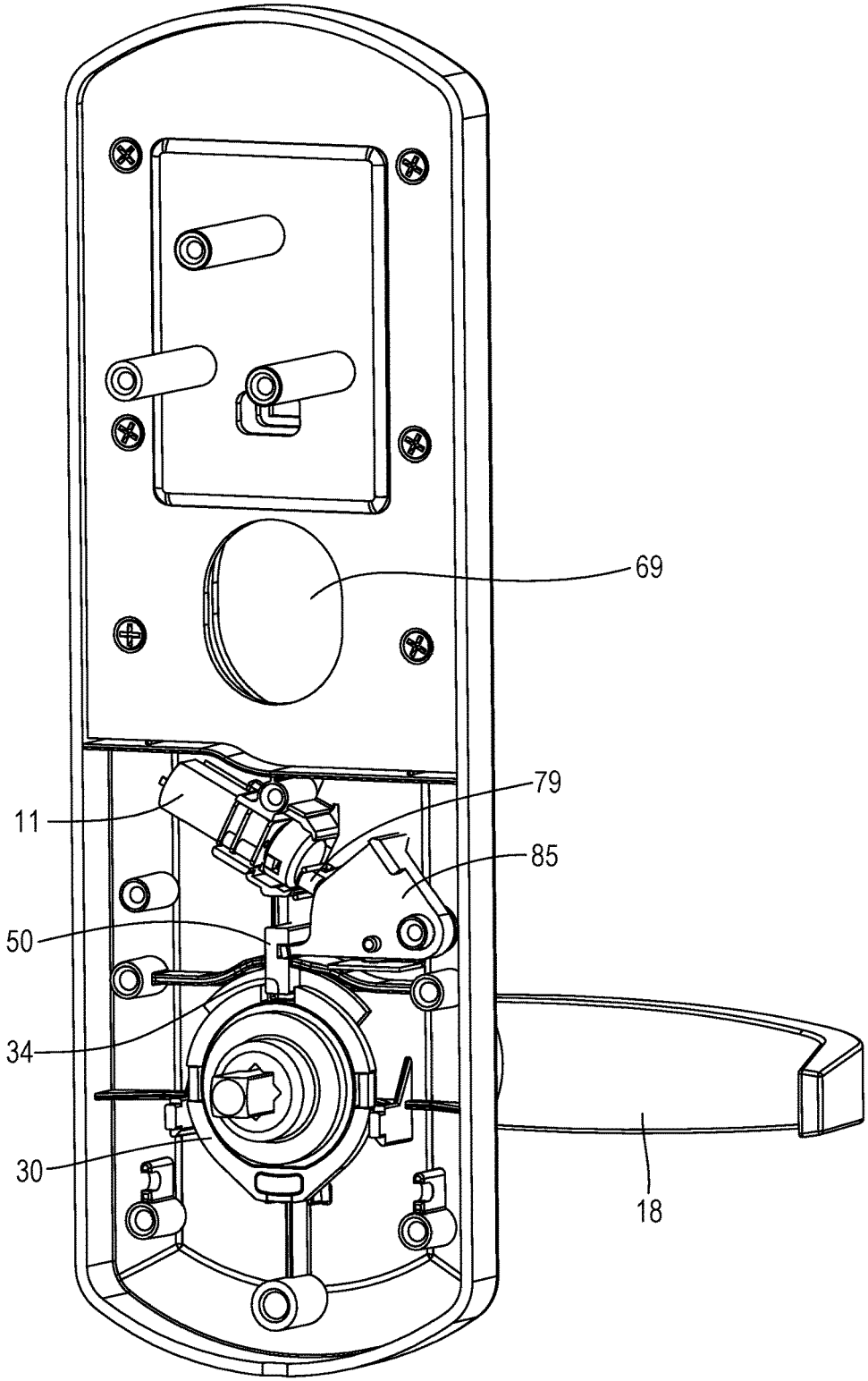
FIG. 4 is a perspective view of the trim assembly of FIG. 2A, with portions of the back plate assembly removed to reveal the inner workings of the trim assembly when in a locked configuration.
Figure 5:
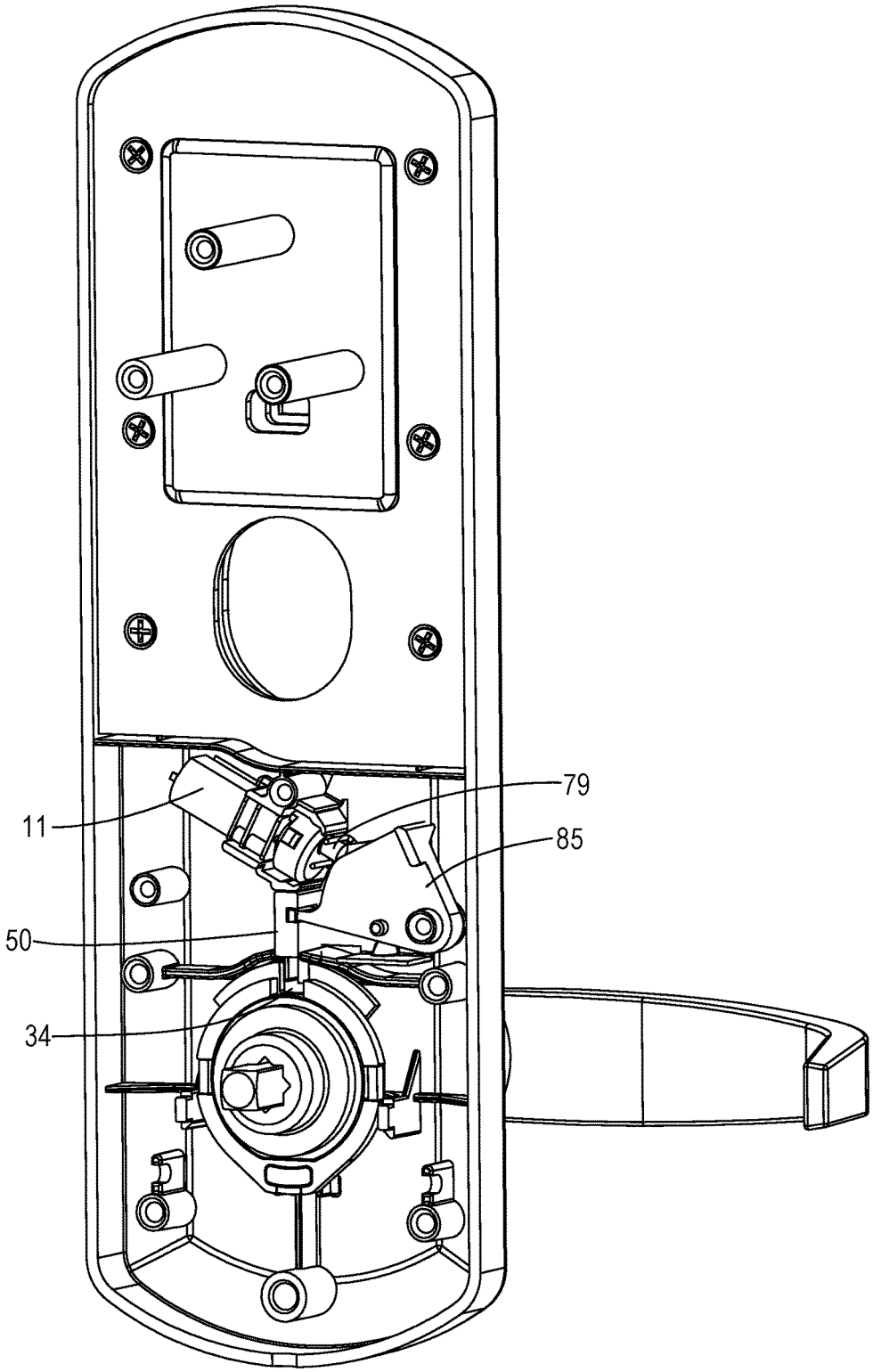
FIG. 5 is like FIG. 4, showing the trim assembly in an unlocked position.
Figure 6:
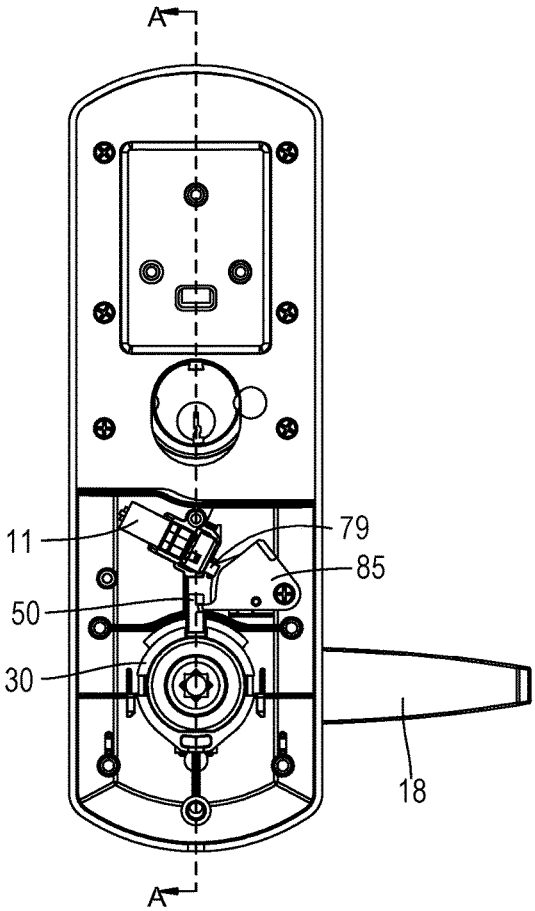
FIG. 6 is a plan view of the trim assembly showing the trim assembly in a locked position.
Figure 7:
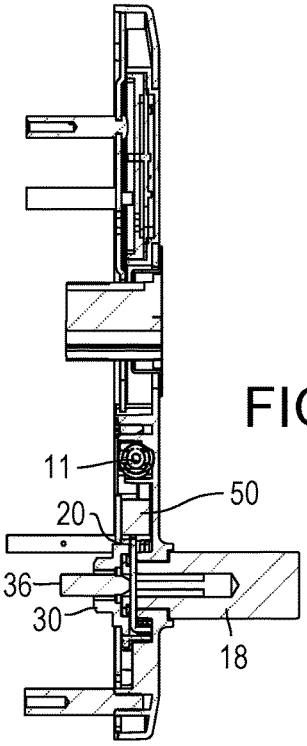
FIG. 7 is a cross-section view of the trim assembly cut along line A-A of FIG. 6, with the trim assembly in a locked position.
Figure 8:
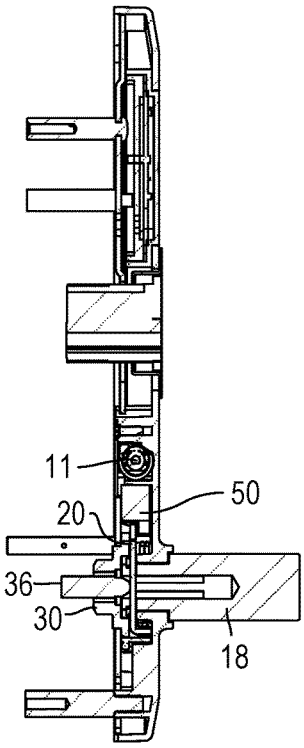
FIG. 8 is another cross-section view of the trim assembly cut along line A-A of FIG. 6, with the trim assembly in an unlocked position.

As best illustrated in FIG. 3, the handle coupler 20 comprises a disk or flange 22 mounted for coaxial rotation with the handle 18, a slot 24 for receiving a stopper 50, and fins 28 on either side of the slot 24. The handle coupler 20 further comprises bent-up tabs 26 that fit into corresponding notches 38 of the spindle driver 30 to detachably couple the handle coupler 20 to the spindle driver 30. The handle coupler 20 also comprises a bridge 23 that fits into the broach 17 of the handle 18. The spindle 36 does not go into the broach 17. Therefore, subjecting the handle 18 to an overtorquing attack shears the bridge 23 without turning the spindle 36.

The handle coupler 20 also comprises a spring leg bracket 21 for mounting opposite legs of a return spring 19. Rotation of the handle coupler 20 pulls and/or pushes the legs of the return spring 19 apart, biasing the handle 18 back toward a neutral, non-latch-retracting position.

Like the handle coupler 20, the spindle driver 30 also has a slot 34 for receiving a stopper 50, although in alternative embodiments, only one of the handle coupler 20 and spindle driver 30 have a slot 24 or 34 for receiving a stopper 50.

Advantageously, the use of the spindle driver 30 in conjunction with the handle coupler 20 not only thwarts overtorquing attacks, but also enables the trim assembly 10 to be adapted to a variety of different spindles with minimal substitution of parts. The spindle driver 30's eight-pronged opening 39 accommodates both spindles 36 that are square and spindles 36 that are diagonally oriented (as shown, for example, by the Corbin spindle in FIG. 2C) when in the neutral, non-latch-retracting position. If the internal latching assembly has a larger or smaller spindle diameter, the trim assembly 10 can be adapted to the spindle 36 simply by swapping out the spindle driver 36 for one with an appropriate-sized spindle aperture.

The motor 11 is mounted to the escutcheon 14 and includes an upper face or bracket 12 and a shaft 13. The shaft 13 is oriented perpendicular to the spindle 36. The driver assembly 60 is mounted on the motor 11 and operative to rotate an eccentrically-positioned offset pin 79 (or, alternatively, a cam) between an engage-lock position and a disengage-lock position.

The driver assembly 60 comprises a slip clutch 62 mounted on the motor 11 and a carousel 76 mounted on the slip clutch 62 for rotational movement with the shaft 13. The carousel 76 rotates the eccentrically-located offset pin 79.

Figure 19:
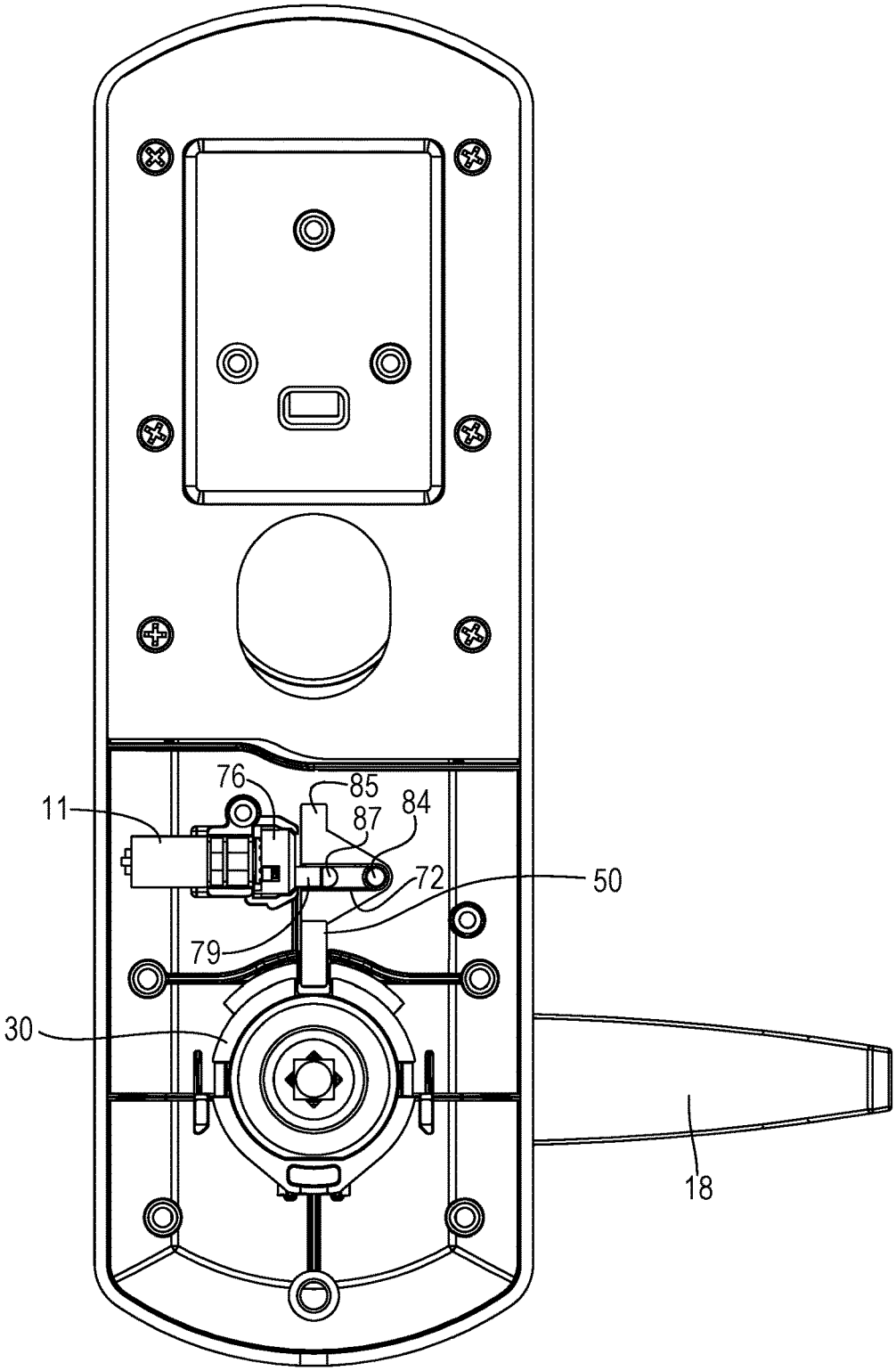
FIG. 19 is a plan view of an alternative embodiment of the trim assembly, with portions of the back plate assembly removed to reveal the inner workings of the trim assembly when in a locked configuration.
Figure 20:
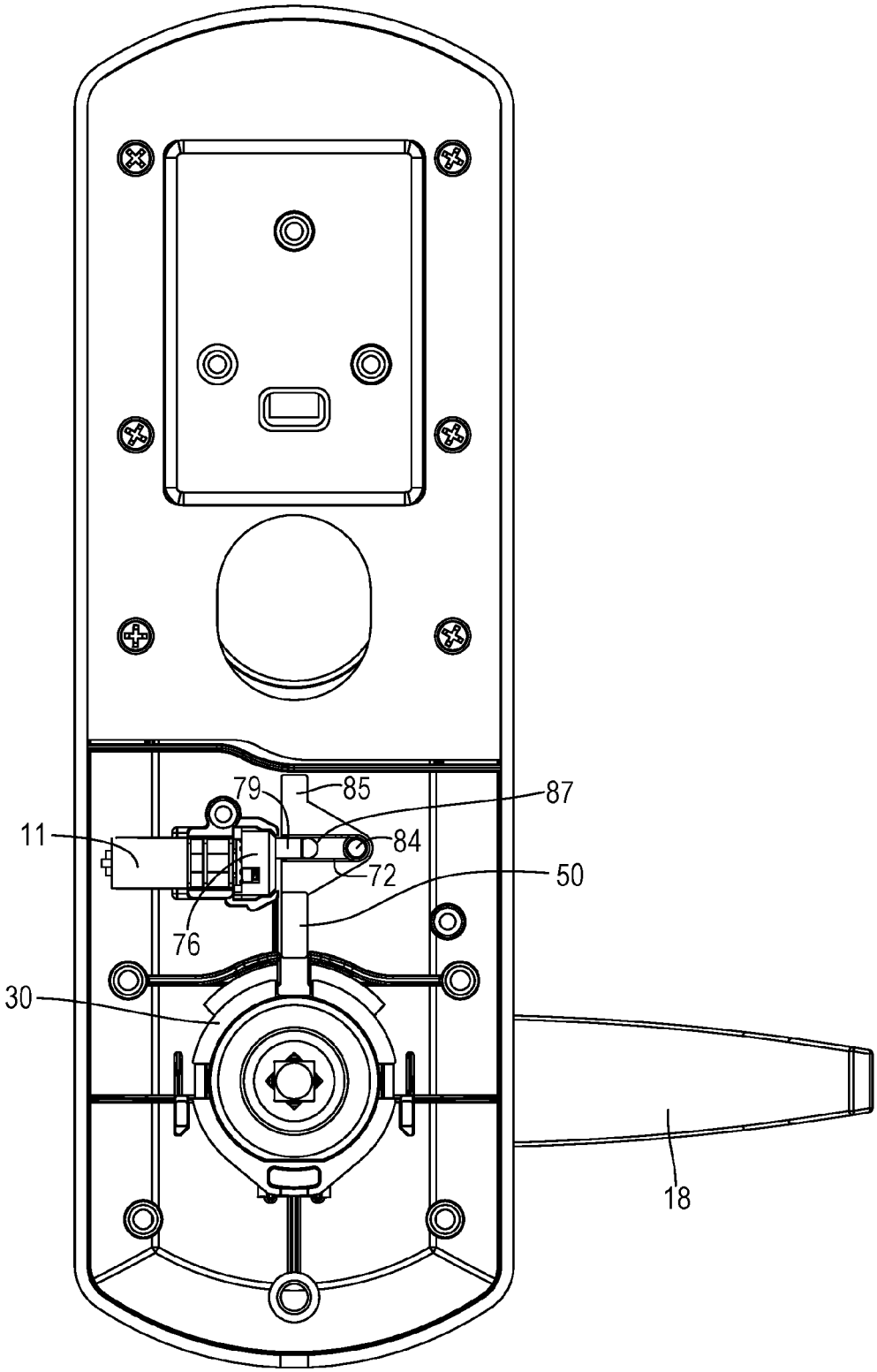
FIG. 20 is another plan view of the alternative embodiment of FIG. 19, showing the trim assembly in an unlocked configuration.
Figure 21:
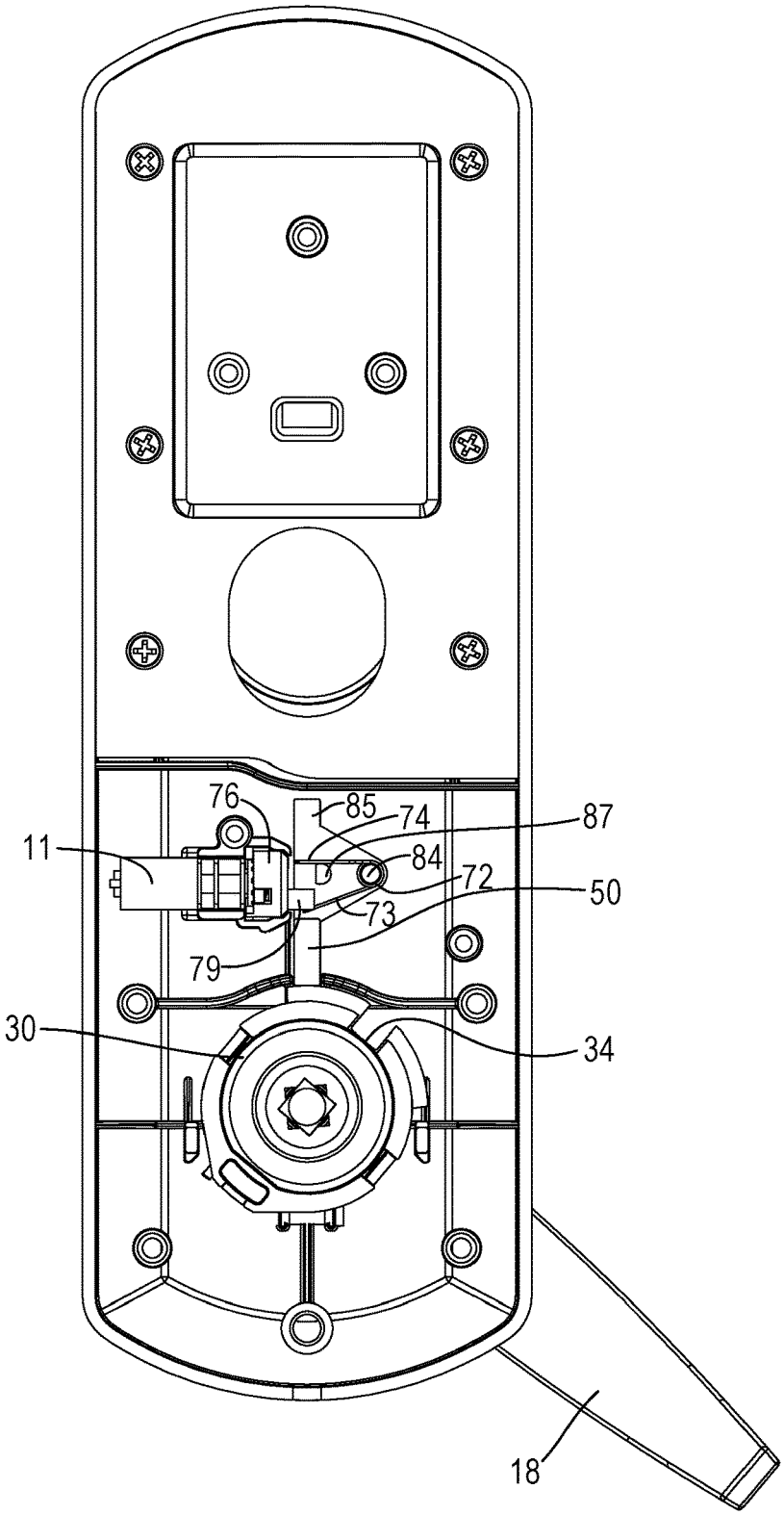
FIG. 21 is another plan view of the alternative embodiment of FIG. 19, showing the trim assembly in an escapement condition.

The escapement assembly 70 comprises a control member 85 and an escapement spring 72. In FIGS. 1-18, the control member 85 is a pivot arm mounted to the escutcheon 14 to pivot about an axis 86 parallel to a spindle axis between locking and unlocking positions. In FIGS. 19-21, the control member 85 is a slider that slides vertically between locking and unlocking positions. (Note that for clarity, structure constraining the slider's movement is not shown in FIGS. 19-21).

Figure 17:
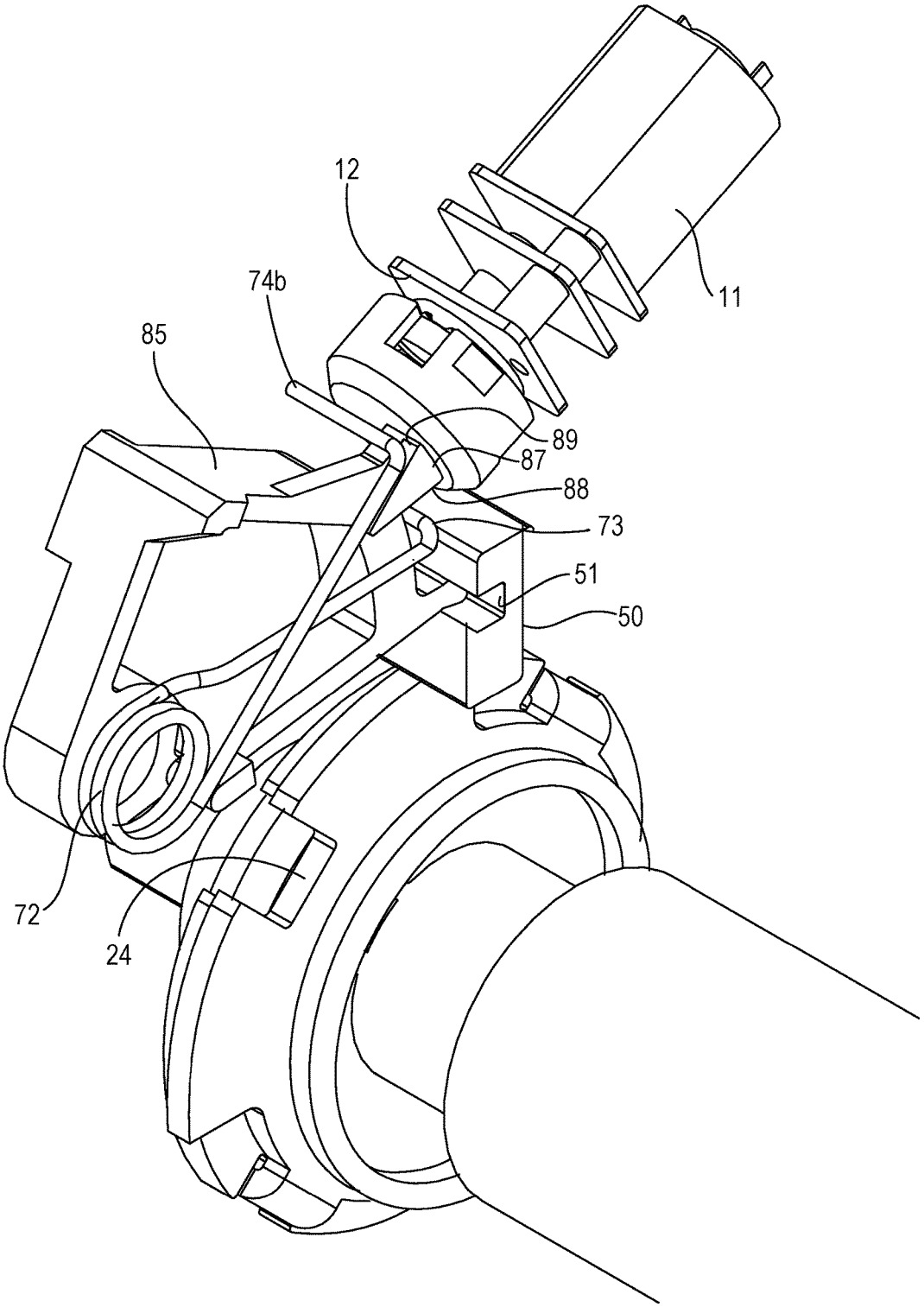
FIG. 17 is a perspective view, from a left side, handle aspect viewpoint, of the inner workings of the trim assembly when in an escapement condition.
Figure 18:
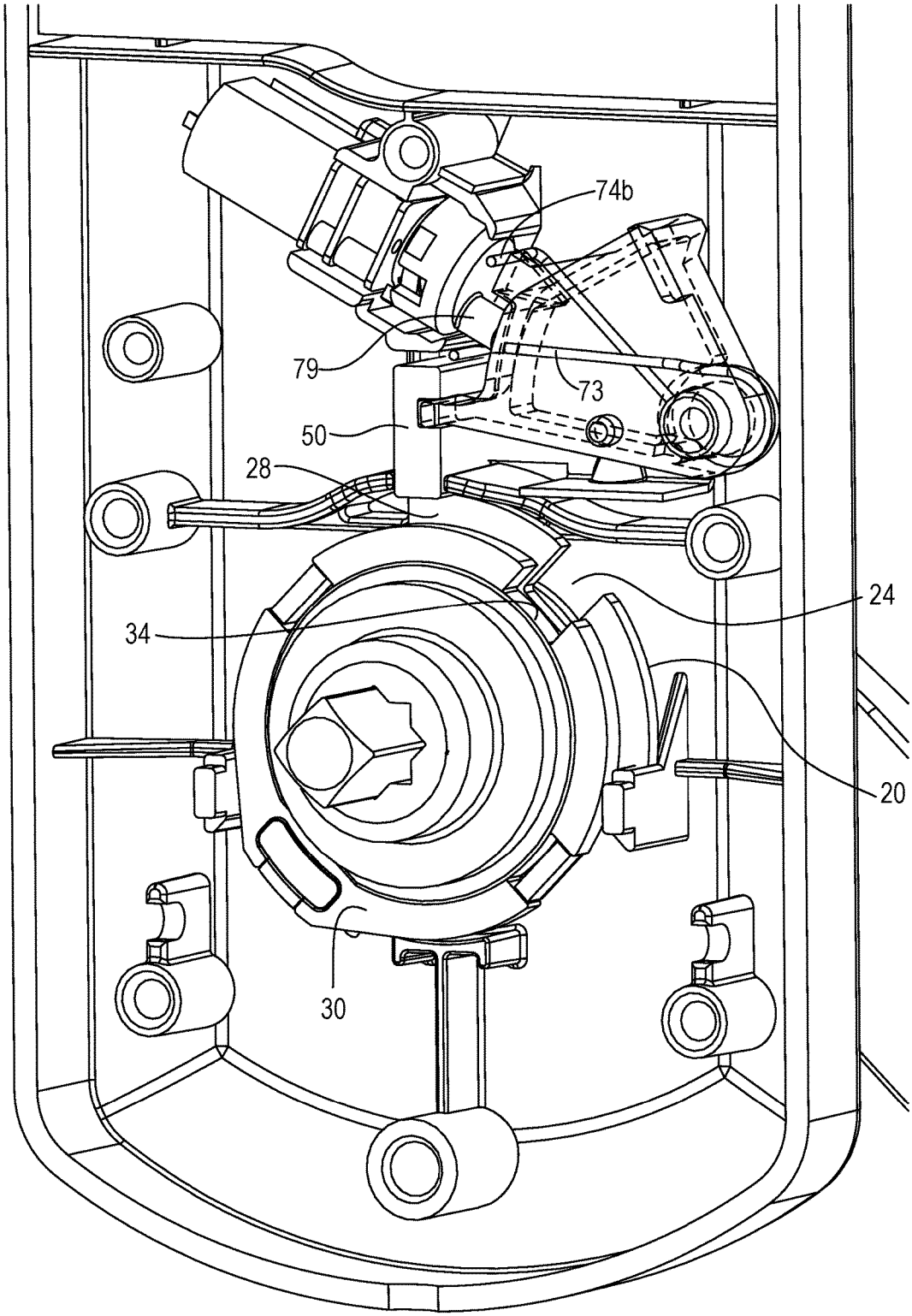
FIG. 18 is a perspective view of the trim assembly when in an escapement condition, with the control member marked in dashed lines to reveal the spread-apart legs of the escapement spring.

The control member 85 either has a pivot member or post 84 (FIGS. 19-21) upon which the coiled core 75 of the escapement spring 72 is mounted, or an aperture 91 (FIGS. 1-18) for receiving a spring pivot (not shown). The coiled core 75 of the escapement spring 72 is mounted to the control member 85 via the post 84 or inserted spring pivot. The control member 85 also has a spring leg anchor or abutment 87. The legs 73, 74 of the escapement spring 72 straddle the spring leg anchor 87. In FIGS. 1-18, the spring anchor 87 is configured as a wedge 87 that has a lower face 88 and a ramped upper face 89 with a wedge angle that matches the angle between the first and second spring legs 73, 74 (FIG. 17). In FIGS. 19-21, the spring anchor 87 is configured as a post. In both embodiments, the first and second spring legs 73, 74 straddle and grasp a wedge-shaped abutment 87 of the control member 85. And in FIGS. 1-18, the spring leg anchor 87 also provides an abutment that acts as a stop to constrain rotation of the offset pin 79 between two rotational limits.

The escapement spring 72 is a helical torsion spring with a coiled core 75, an axis 86 parallel to the spindle's axis, and two legs 73, 74. Each leg has an elongated radially extending portion 73*a*, 74*a* and an axially extending portion 73*b*, 74*b* (FIG. 3). In FIGS. 1-18, the spring 72 is mounted to the control member 85 by forcing the legs 73, 74 to intersect each other and straddle the spring leg anchor 87. In FIGS. 19-21, the legs of the escapement spring 72 do not intersect.

Figure 9:
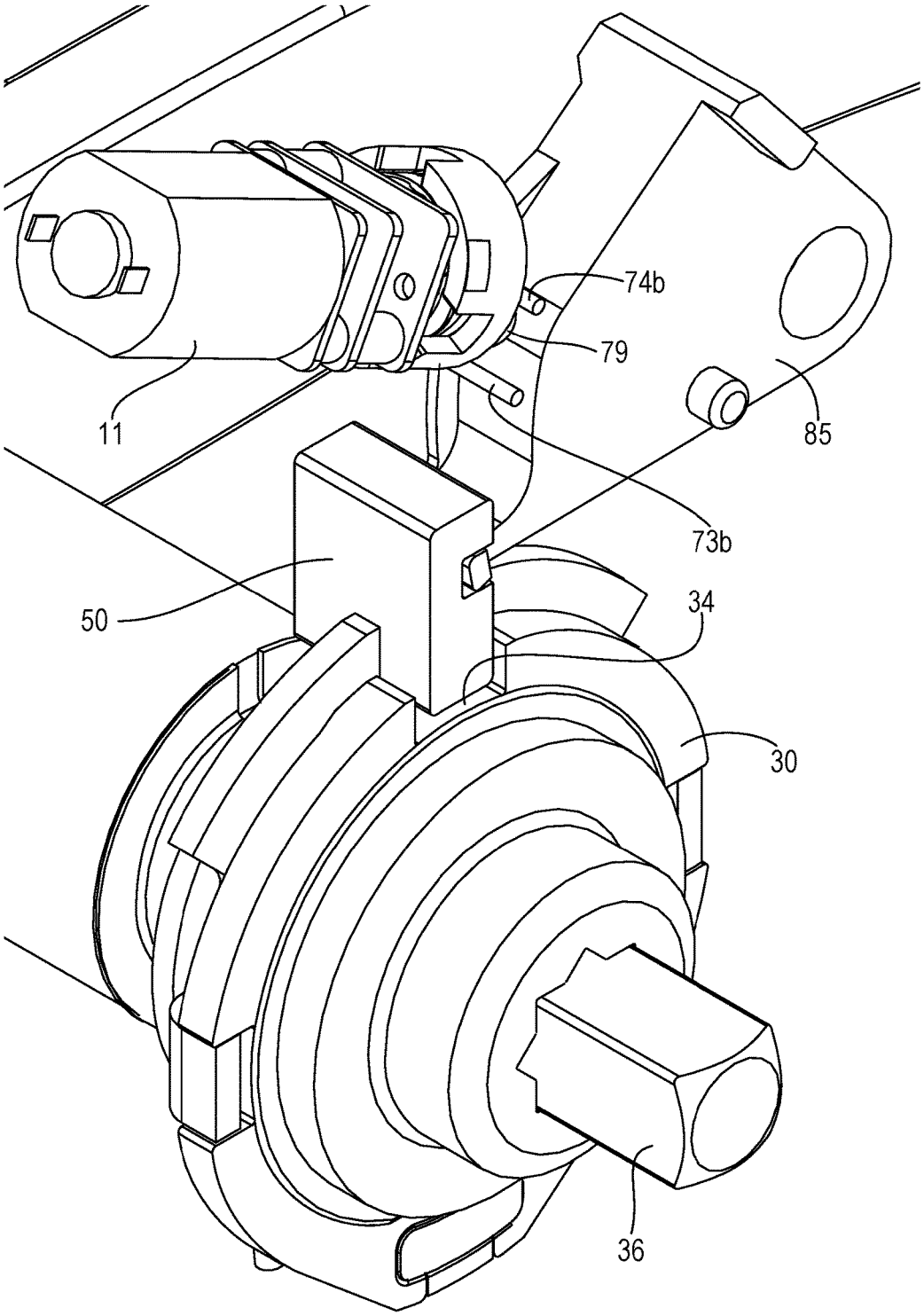
FIG. 9 is a perspective view, from a left side, spindle aspect viewpoint, of the inner workings of the trim assembly when in a locked position.
Figure 10:
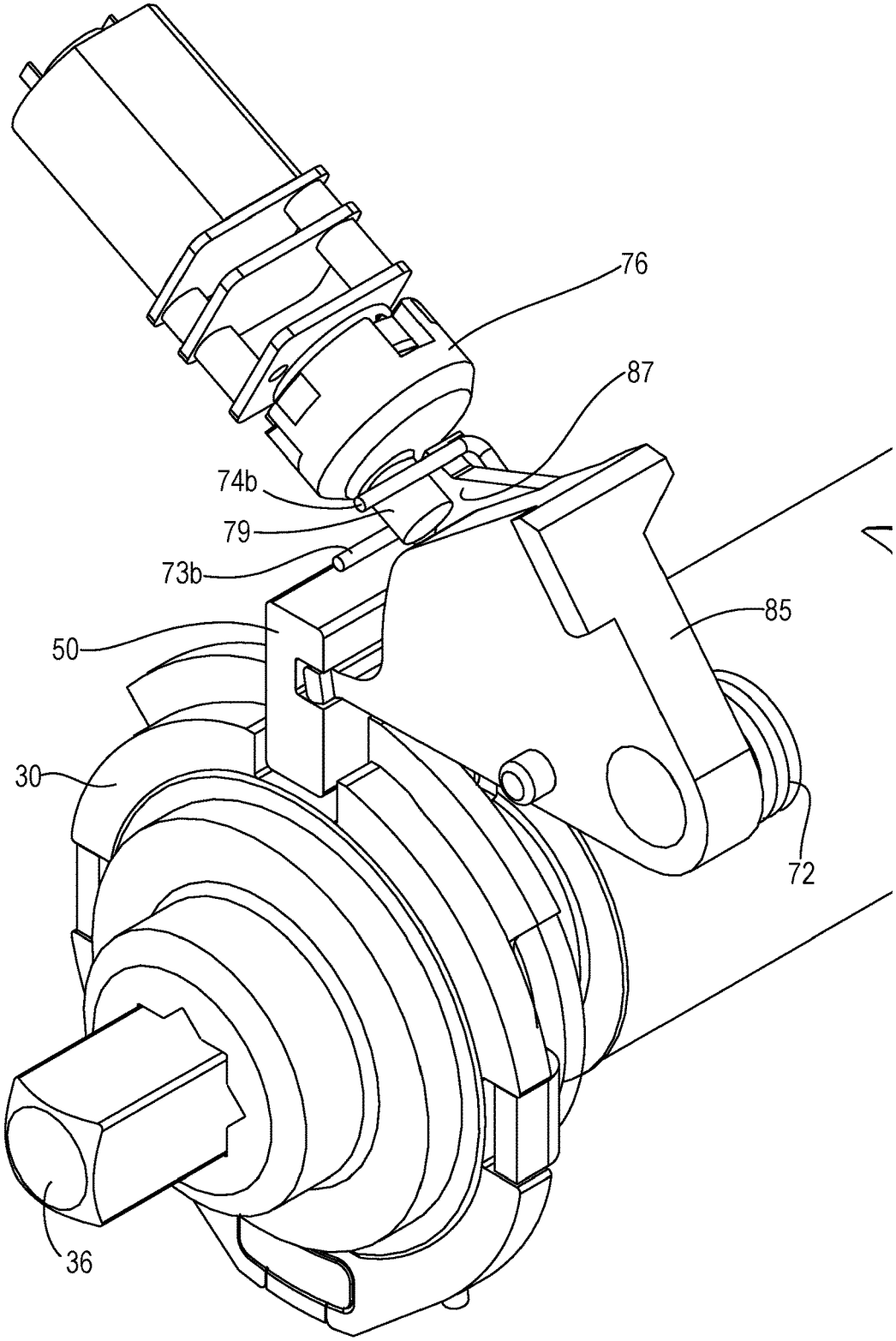
FIG. 10 is a perspective view, from a right side, spindle aspect viewpoint, of the inner workings of the trim assembly when in a locked position.
Figure 11:
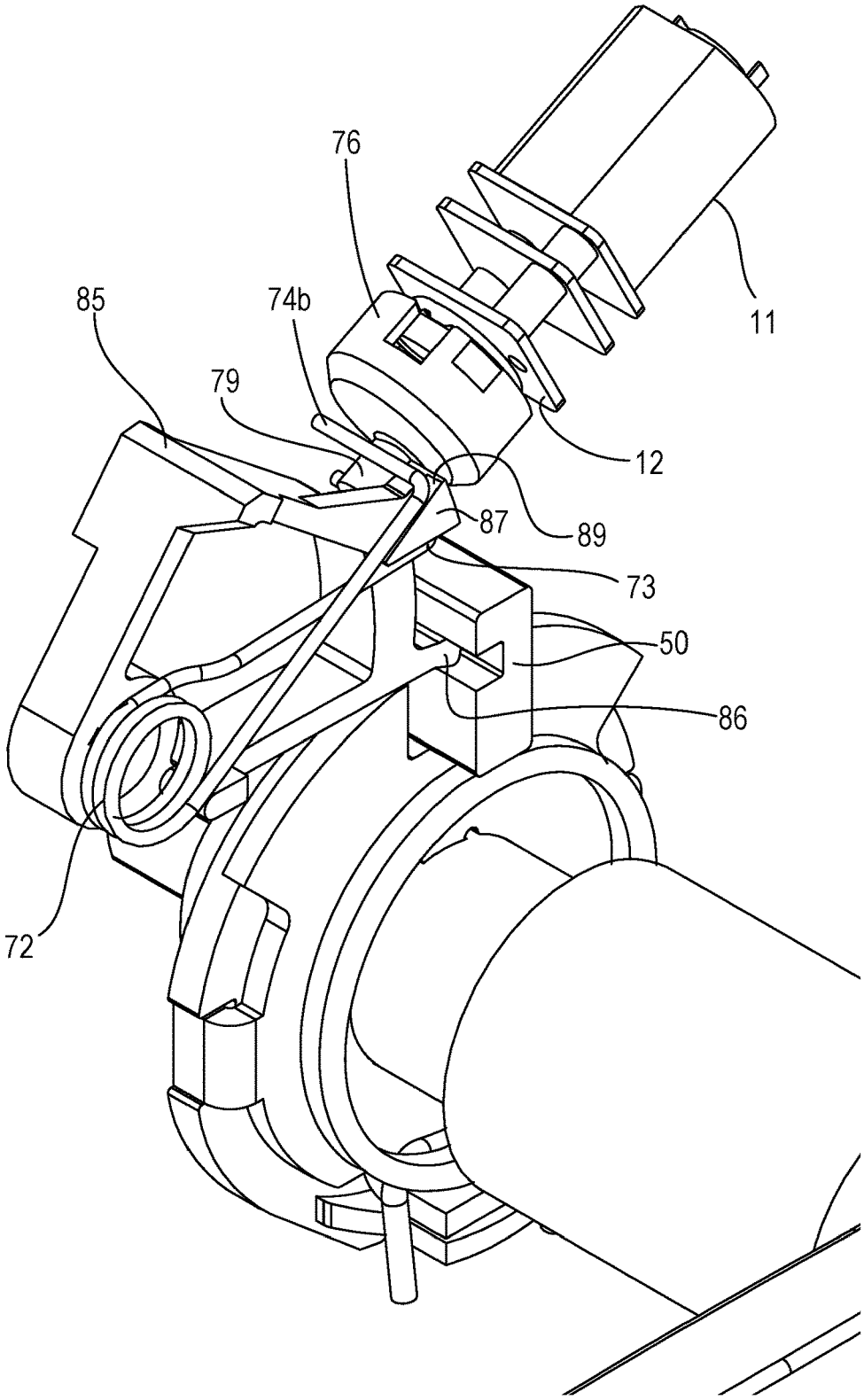
FIG. 11 is a perspective view, from a left side, handle aspect viewpoint, of the inner workings of the trim assembly when in a locked position.
Figure 12:
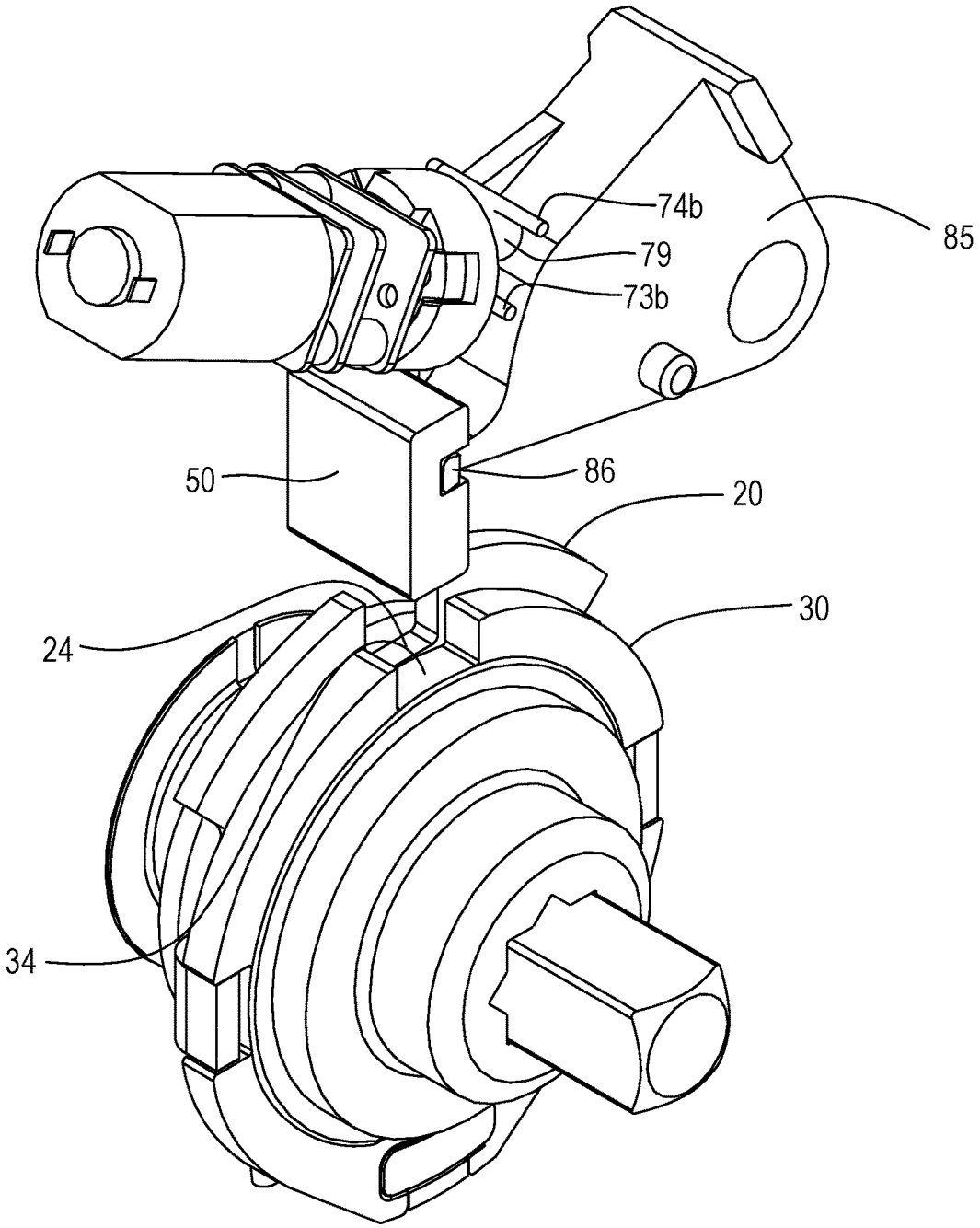
FIG. 12 is a perspective view, from a left side, spindle aspect viewpoint, of the inner workings of the trim assembly when in an unlocked position.
Figure 13:
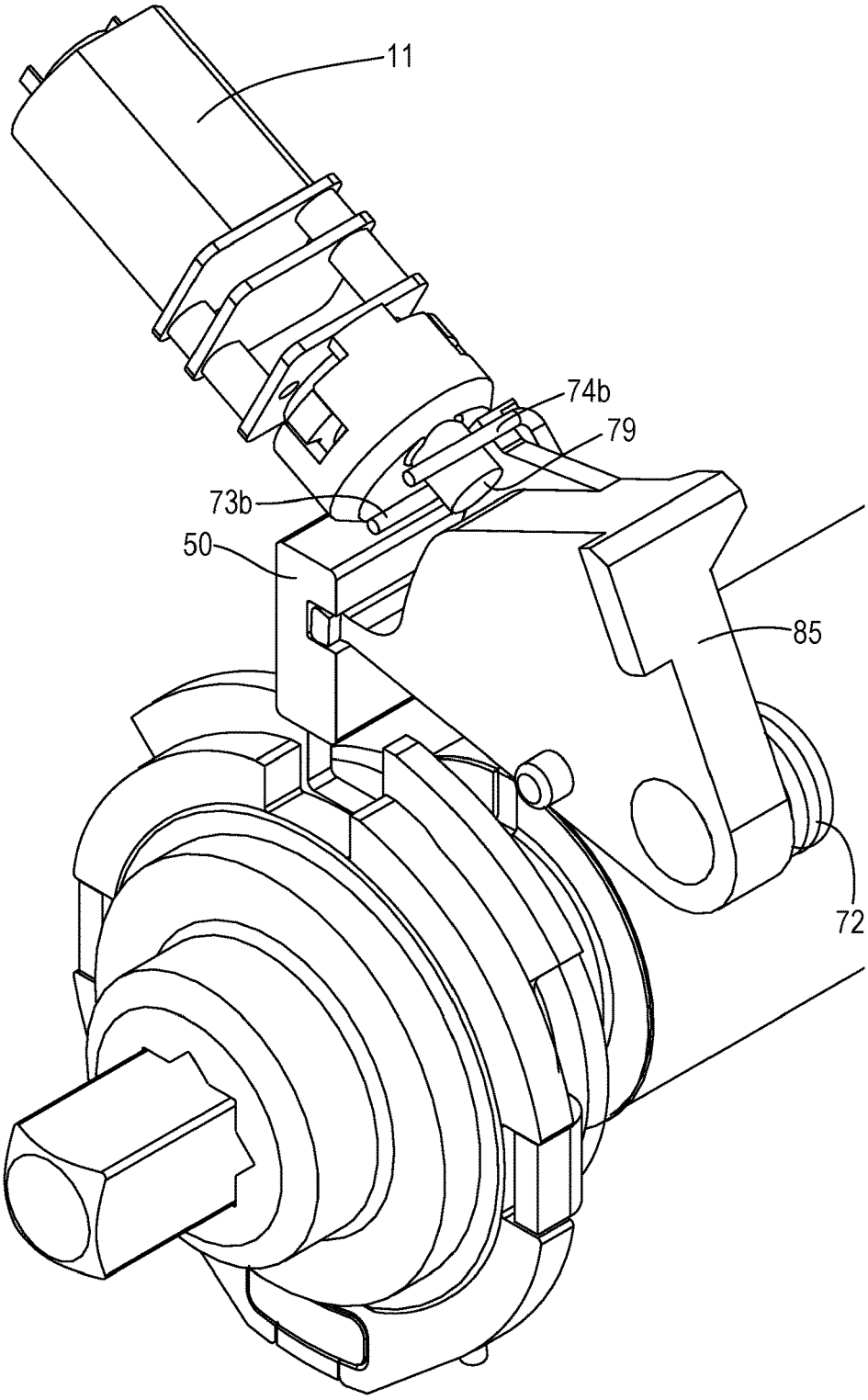
FIG. 13 is a perspective view, from a left side, spindle aspect viewpoint, of the inner workings of the trim assembly when in an unlocked position.
Figure 14:
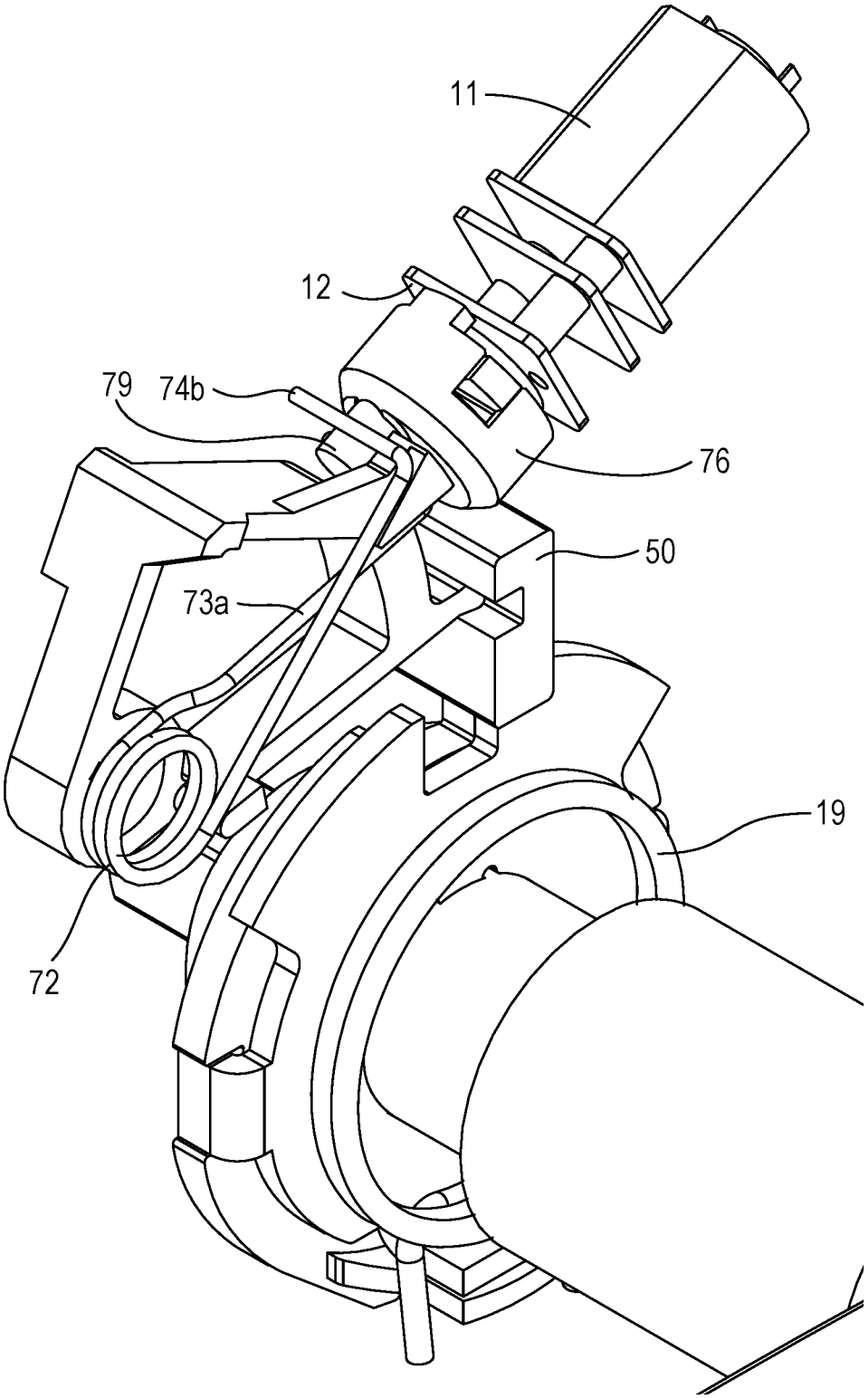
FIG. 14 is a perspective view, from a left side, handle aspect viewpoint, of the inner workings of the trim assembly when in an unlocked position.
Figure 15:
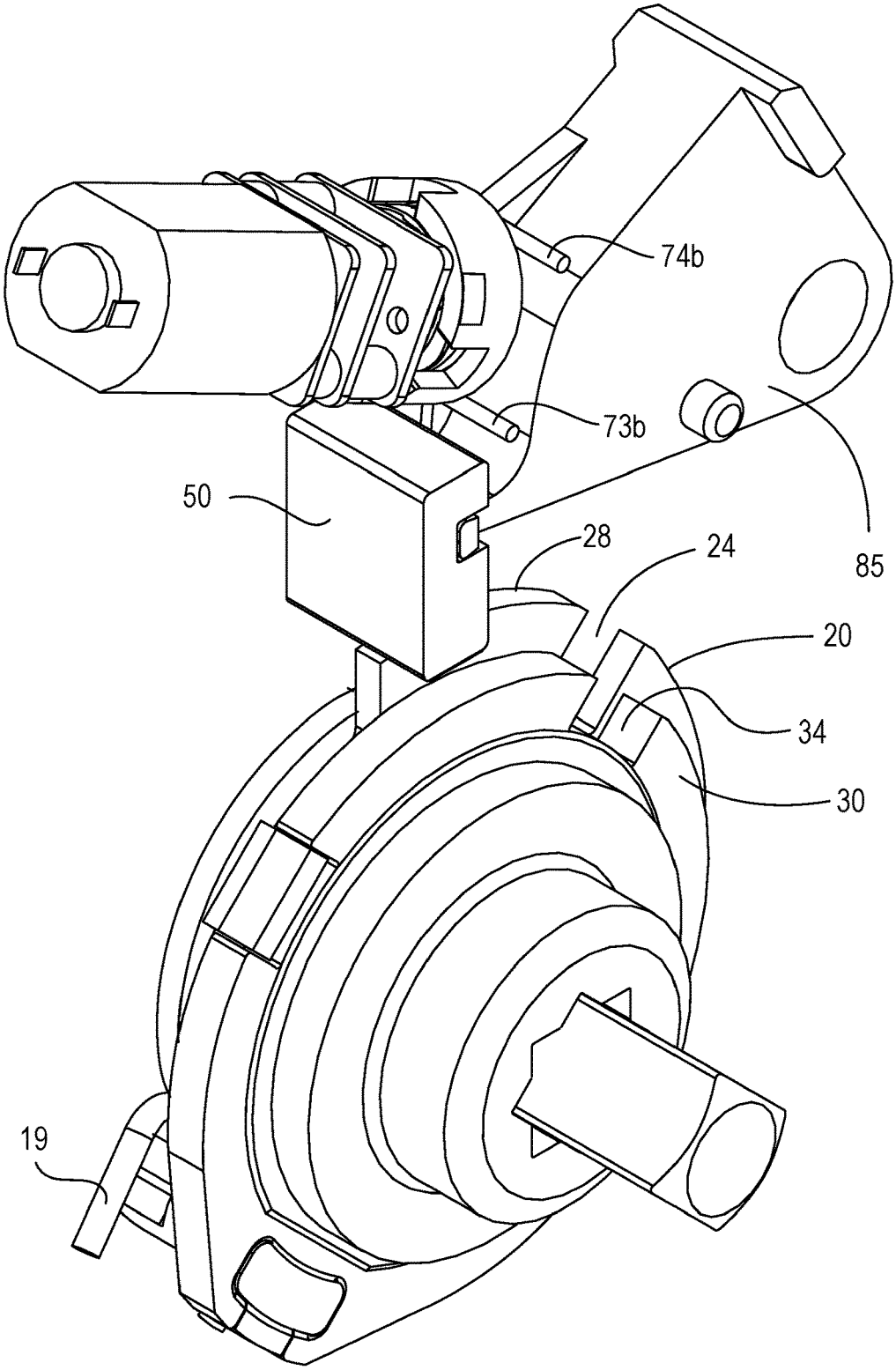
FIG. 15 is a perspective view, from a left side, spindle aspect viewpoint, of the inner workings of the trim assembly when in an escapement condition.
Figure 16:
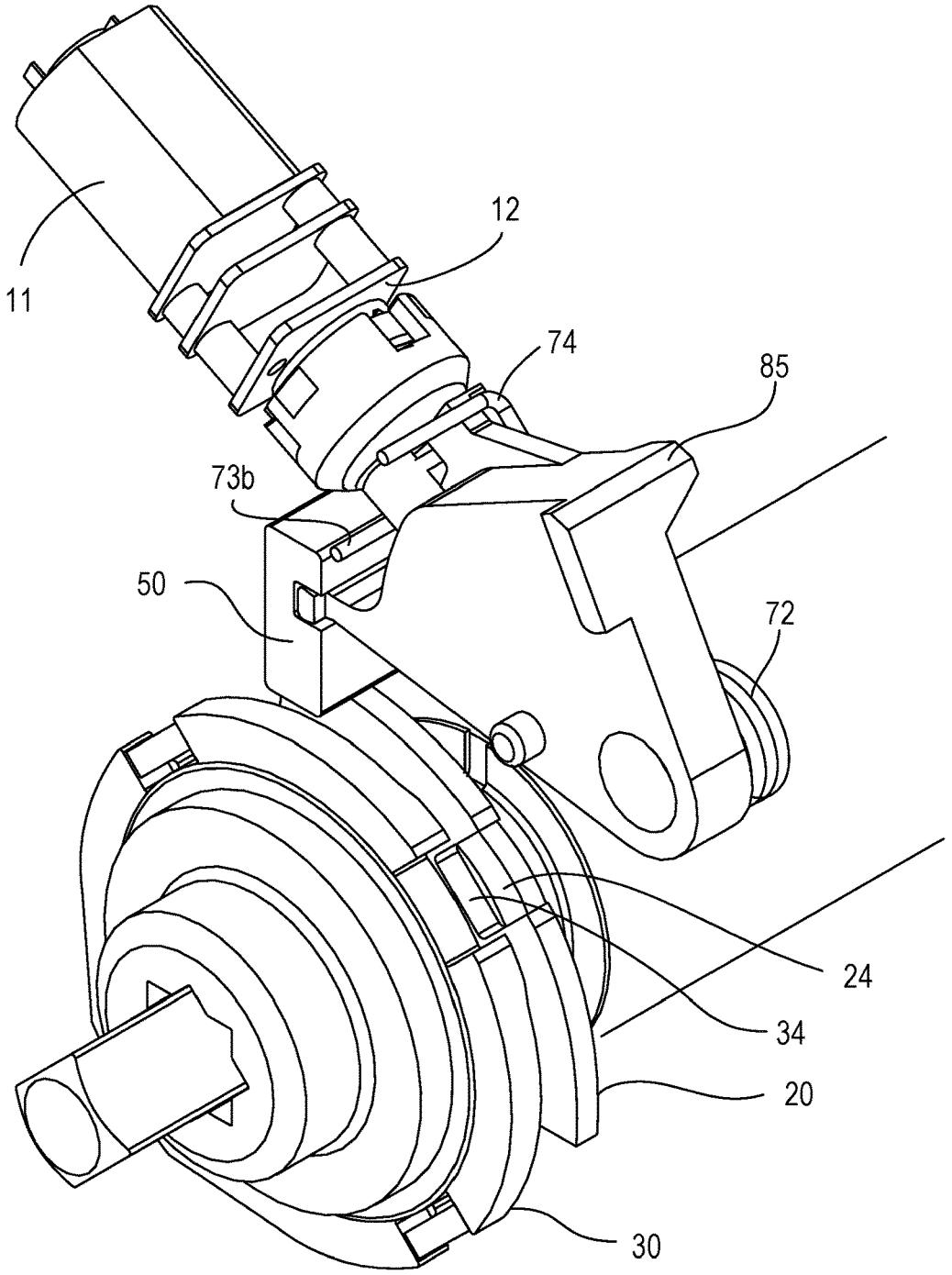
FIG. 16 is a perspective view, from a left side, spindle aspect viewpoint, of the inner workings of the trim assembly when in an escapement condition.

The axially extending portions 73*b*, 74*b* of the first and second spring legs 73, 74 extend beyond the spring leg anchor 87 into positions above and below the offset pin 79. If non-alignment of the spindle driver slot 34 and/or handle coupler slot 24 blocks the stopper 50 from engaging the spindle driver slot 34 and/or handle coupler slot 24, rotation of the offset pin 79 into an engage-lock position forces the lower spring leg 73 downward and away from the lower face or edge 88 of the spring leg anchor 87, as illustrated in FIGS. 15-18 and 21. This spreads the spring legs 73, 74 apart, winding the coiled core of the escapement spring 72 and storing energy. (Note that in the non-intersecting spring leg embodiment of FIGS. 19-21, the spring is wound oppositely of the embodiment of FIGS. 1-18). Assuming that the carousel 76 is maintained in the same position, realignment of the spindle driver 30 and handle coupler 20 allows the spring 72 to release the stored energy by driving the upper spring leg 74 and control member 85 in a downward direction, until the stopper 50 is engaged with the spindle driver slot 34, as illustrated in FIGS. 9-11.

In FIGS. 1-18, a hanger 86 projects out from the control member 85. The hanger is configured to fit in a slot 51 of the stopper 50 in order to carry the stopper 50 between locked and unlocked positions. In FIGS. 19-21, the stopper 50 is rigidly coupled to, or simply an extension of, the control member 85. In both embodiments, the stopper 50 is operative for radial movement between a locked configuration that blocks the spindle driver 30 and/or handle coupler 20 from rotating and an unlocked configuration in which the spindle driver 30 and handle coupler 20 are free to rotate. In a locked configuration, the stopper 50 engages the spindle driver slot 34 and/or handle coupler slot 24, blocking the spindle driver 30 from rotating.

The offset pin 76, control member 85, and escapement spring 72 are respectively arranged so that rotation of the offset pin 79 between its rotational limits biases the control member 85 to travel between its locking position (FIGS. 9-11, 19) and its unlocking position (FIGS. 12-14, 20). They are also arranged so that the offset pin 79 is in contact with and operative to push the second leg 73 of the escapement spring 72 away from the first leg 74 of the spring 72, thereby biasing the control member 85 toward the locking position. If the spindle driver slot 34 and/or handle coupler slot 24 are not aligned with the stopper 50, then one of the fins 28 of the handle coupler 20 blocks the stopper 50 from descending into a locking position. Rotating the offset pin 79 into the engage-lock position results in a first escapement condition, described further below, in which the offset pin 79 pushes the second leg 73 of the escapement spring 72 away from the first leg 73, as shown in FIGS. 15-18 and 21. The stored energy of the spring 72 biases the control member 85 toward the locking position. If the spindle driver 30 rotates from a position in which the slot 24 and/or 34 is/are not aligned with the stopper 50 to a position in which the slot 24 and/or 34 is/are aligned with the stopper 30, the biasing of the escapement spring 72 pushes the stopper 50 into the slot 24 and/or 34.

The escapement assembly 70 is operative under a non-escapement condition and at least a first escapement condition. The first escapement condition is characterized by an attempt to lock the door when the stopper 50 is not aligned with the spindle driver slot 34 and/or handle coupler slot 24. Until alignment is restored, the stopper 50 is blocked from extending into the slot 24 and/or 34.

Movement of the handle 18 and handle coupler 20 into a neutral, non-latch-retracting position lines the stopper 50 up with the handle coupler slot 24. Once aligned, the stored energy of the escapement spring 72 rotates the control member 85 down, extending the stopper 50 into the slot 24 and/or 34, thus locking the handle 18 in a non-latch-retracting position.

A second escapement condition is characterized by an attempt to unlock the door while the locked lever arm 18 is being pushed on. The asymmetry of the load exerted on the stopper 50 may have a binding effect, preventing the stopper 50 from retracting out of the slot 24 and/or 34. Under this condition, rotation of the offset pin 79 into a disengage-lock position will push the upper leg 74 of the escapement spring 72 upward and away from the ramped upper surface 89 of the spring anchor 87, again winding up and storing energy in the spring 72. Once pressure is released from the lever arm 18, thereby removing the binding effect, the spring 72 forces the control member 85 up, retracting the stopper 50 away from the slot 24 and/or 34.

In the non-escapement condition, by contrast, the spring anchor 87 stays in substantial alignment with the offset pin 79 as the offset pin 79 rotates between engage-lock and disengage-lock positions.

In either escapement condition, the control member 85 is blocked from rotating, thereby impeding movement of one of the legs 73, 74 of the escapement spring 72. Operation of the motor 11 in either escapement condition causes the pin 79 to spread the axially extending portions 73*b*, 74*b* of the legs 73, 74 apart, winding up and storing energy in the escapement spring 72. Once the stopper 50 is free to travel between locked and unlocked positions, the stored-up energy of the wound-up escapement spring 72 is released into control member 85, causing the control member 85 to rotate until the spring legs 73 and 74 reach their minimum-energy condition, in which they are once again grasping the spring anchor 87.

The driver assembly 60 optionally comprises a slip clutch 62 mounted to the motor 11. The slip clutch 62—which, in one embodiment, comprises an over-torque clutch—comprises a keyhole for receiving the motor shaft 13, a stationary portion mounted to the motor bracket 12, and a carousel 65 driven within torque limits by the motor shaft 13. Carousel couplers 66 couple the carousel 65 to the pin carrier 76 for synchronized rotation therewith. In another embodiment, the motor 11 is directly connected to the pin carrier 76.

Figure 2A:
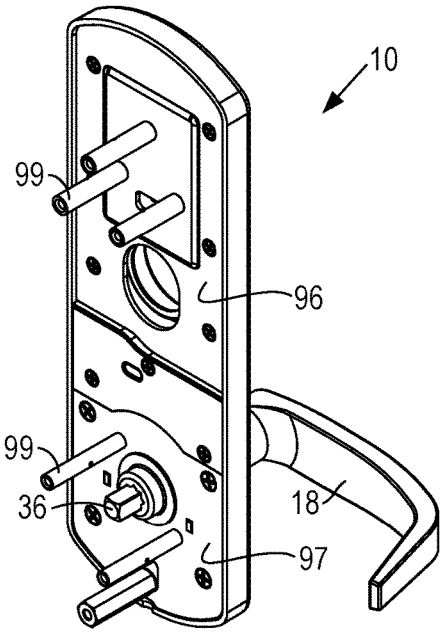
FIG. 2A is a perspective view of the trim assembly of FIG. 1, in assembled form.
Figure 2B:
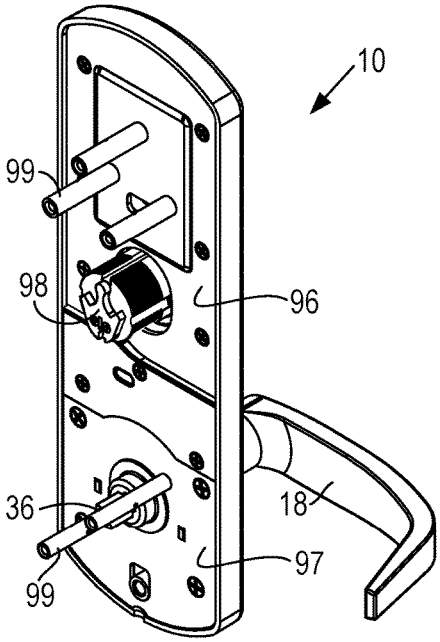
FIG. 2B is a perspective view of an alternative embodiment of an assembled trim assembly.
Figure 2C:
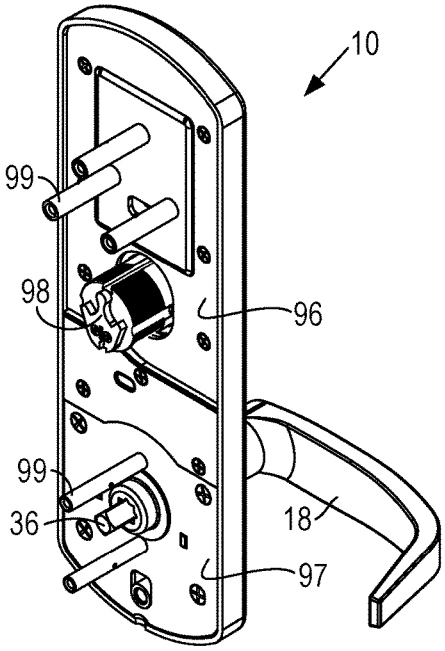
FIG. 2C is a perspective view of another alternative embodiment of an assembled trim assembly.
Figure 2D:
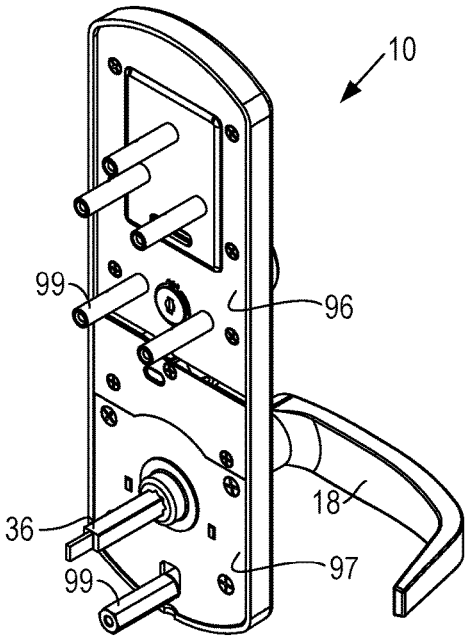
FIG. 2D is a perspective view of yet another alternative embodiment of an assembled trim assembly.

Advantageously, the back plate assembly 15 allows trim mounting posts 99 to be mounted to the trim assembly 10 in a variety of arrangements, to accommodate a variety of existing borehole and trim mounting hole arrangements, without interfering with the motor 11, driver assembly 60, and escapement assembly 70. In the embodiment shown, the back plate assembly 15 comprises an upper plate or deadbolt plate 96, a mid plate 93 positioned over the motor 11, driver assembly 60, and escapement assembly 70, and a bottom plate or spindle plate 97. Posts 99 can be mounted to the plates 93, 96, and 97 wherever necessary to adapt the trim assembly to any of a variety of configurations of trim mounting holes on an existing door. In FIG. 2A, for example, two posts 99 are positioned at relative 4:30 and 10:30 o'clock positions on the spindle plate 97. In FIG. 2B, two posts 99 are positioned at relative 1:30 and 7:30 o'clock positions on the spindle plate 97. And in FIG. 2D, which depicts a trim assembly 10 for an exit door, a single post 99 is positioned at the 6:00 o'clock position on the spindle plate 97. Also, the deadbolt plate 96 provides an elongated aperture 69 for receiving a deadbolt assembly. This accommodates variable spacing that may exist in existing doors between the deadbolt borehole and the spindle 36.

Also advantageously, the trim assembly 10 is configured and arranged in a manner that shares much in common with the trim assembly described and depicted in my co-pending U.S. patent application Ser. No. 15/047,521, Feb. 18,2016, and entitled "Door Trim Assembly with Clutch Mechanism," which application is herein incorporated by reference for all purposes. Many of the components are the same or substantially the same. The back plate assembly 15 and spindle driver 30, for example, are the same. The same handle 14 may be used. The escutcheon 14, for example, is the same except for a few stamped parts. The commonalities between the locks reduce the cost of manufacture and allow for a more uniform set of instructions in assembling either trim assembly to a door.

Several different types of motors 11 are suitable for use with the present invention. In one embodiment, a stepper motor is used. In another embodiment, gear motor is used in conjunction with an over torque clutch 62.

It should be noted that the embodiments illustrated and described in detail herein are exemplary only, and that various other alternatives, adaptations, and modifications may be made within the scope of the present invention. Accordingly, the present invention is not limited to the specific embodiments illustrated herein, but is limited only by the following claims.

I claim:

1. An apparatus comprising:

a motor;

a motor-operated driver;

an escapement assembly coupled to a stopper, the escapement assembly comprising a spring coupler and a spring, wherein the motor operates the driver to move the spring coupler into positions that either (a) cause movement of the stopper or (b) store energy in the spring until the stopper can be moved;

a coupling assembly, comprising a handle coupler detachably coupled to a spindle driver, for coupling a door handle to a latch-retracting spindle, wherein the spindle driver has a slot for receiving the stopper to prevent a spindle from rotating;

the motor being configured to enable latch retraction by acting upon the driver to act upon the escapement assembly to urge the stopper from a locking position that prevents rotation of the spindle to an unlocking position that does not prevent rotation of the spindle;

the coupling assembly moving between a default orientation and a rotated orientation, wherein the default orientation allows the stopper to move into the spindle driver slot, and wherein the rotated orientation blocks the stopper from moving into the spindle driver slot;

wherein when the coupling assembly is in the default orientation, the motor is operable to move the stopper between the unlocking position and the locking position;

wherein when the coupling assembly is in the rotated orientation, operation of the motor to urge the blocked stopper into the locking position stores energy in the spring to force the stopper into the spindle driver slot once the coupling assembly moves back to the default orientation; and wherein when the handle coupler is locked by the stopper, the spindle driver is configured to detach from the handle coupler while the spindle driver stays locked when the handle coupler is subjected to an overtorquing attack.

2. The apparatus of claim 1, wherein the coupling assembly comprises a spindle driver that has a spindle aperture for receiving a spindle.

3. An apparatus of claim 1, comprising:

a motor;

a motor-operated driver;

an escapement assembly coupled to a stopper, the escapement assembly comprising a spring coupler and a spring, wherein the motor operates the driver to move the spring coupler into positions that either (a) cause movement of the stopper or (b) store energy in the spring until the stopper can be moved;

wherein the driver comprises an offset pin eccentrically mounted on a carousel driven to rotate by the motor, wherein the offset pin converts rotary motion of the carousel into linear motion that either (a) causes movement of the stopper or (b) stores energy in the spring until the stopper can be moved;

a spindle lock with a curved perimeter sections that couples a door handle to a latch-retracting spindle and including a slot between the curved perimeter sections for receiving the stopper to prevent a latch-retracting spindle from rotating;

the motor being configured to enable latch retraction by acting upon the driver to act upon the escapement assembly to urge the stopper from a locking position that prevents rotation of the spindle to an unlocking position that does not prevent rotation of the spindle;

the spindle lock rotating between a default orientation and a rotated orientation, wherein the default orientation allows the stopper to move into the spindle lock slot, and wherein in the rotated orientation, one of the curved perimeter sections blocks the stopper from moving into the spindle lock slot;

wherein when the spindle lock is in the default orientation, the motor is operable to move the stopper between the unlocking position and the locking position;

wherein when the spindle lock is in the rotated orientation, operation of the motor to urge the blocked stopper into the spindle driver slot stores energy in the spring to force the stopper into the spindle lock slot once the coupling assembly moves back to the default orientation.

4. The apparatus of claim 3, wherein the spring has two legs, and the offset pin is coupled to the spring legs, so that movement of the offset pin pushes on one or the other of the spring legs.

5. The apparatus of claim 4, wherein the spring coupler comprises a spring leg anchor, and the spring legs straddle the spring leg anchor of the spring coupler.

6. The apparatus of claim 4, wherein when the coupling assembly is in the rotated orientation, operation of the motor to rotate the offset pin to drive the blocked stopper into the locking position spreads apart the spring legs.

7. The apparatus of claim 6, wherein the spring leg anchor constrains rotation of the offset pin between two rotational limits.

8. The apparatus of claim 3, wherein when the spindle lock is in the default orientation, operation of the motor to enable latch retraction rotates the carousel and pin into a position that pivots the spring coupler into a position that urges the stopper into the unlocking position.

9. An apparatus comprising:

a door latch;

a door handle;

a motor;

a motor-operated driver;

an escapement assembly coupled to a stopper, the escapement assembly comprising a spring coupler and a spring, wherein the motor operates the driver to move the spring coupler into positions that either (a) cause movement of the stopper or (b) store energy in the spring until the stopper can be moved;

a coupling assembly, comprising a handle coupler detachably coupled to a spindle driver, for coupling a door handle to a latch-retracting spindle, wherein the spindle driver has a slot for receiving the stopper to prevent a spindle from rotating;

the motor being configured to enable latch retraction by acting upon the driver to act upon the escapement assembly to urge the stopper from an unlocking position that does not prevent rotation of the spindle and a locking position that prevents rotation of the spindle;

the coupling assembly moving between a default orientation and a rotated orientation, wherein the default orientation allows the stopper to move into the spindle driver slot, and wherein the rotated orientation blocks the stopper from moving into the spindle driver slot;

wherein when the coupling assembly is in the default orientation, the motor is operable to move the stopper between the unlocking position and the locking position;

wherein when the coupling assembly is in the rotated orientation, operation of the motor to urge the blocked stopper into the locking position stores energy in the spring to force the stopper into the spindle driver slot once the coupling assembly moves back to the default orientation; and wherein when the handle coupler is locked by the stopper, the spindle driver is configured to detach from the handle coupler while the spindle driver stays locked when the handle coupler is subjected to an overtorquing attack.

10. The apparatus of claim 9, wherein the coupling assembly comprises a spindle driver that has a spindle aperture for receiving a spindle.

11. The apparatus of claim 9, wherein the driver comprises an offset pin eccentrically mounted on a carousel driven to rotate by the motor, wherein the offset pin converts rotary motion of the carousel into linear motion that either (a) causes movement of the stopper or (b) stores energy in the spring until the stopper can be moved.

12. The apparatus of claim 11, wherein the spring has two legs, and the offset pin is coupled to the spring legs, so that movement of the offset pin pushes on one or the other of the spring legs.

13. The apparatus of claim 12, wherein the spring coupler comprises a spring leg anchor, and the spring legs straddle the spring leg anchor of the spring coupler.

14. The apparatus of claim 12, wherein when the coupling assembly is in the rotated orientation, operation of the motor to rotate the offset pin to drive the blocked stopper into the locking position spreads apart the spring legs.

15. The apparatus of claim 14, wherein the spring leg anchor constrains rotation of the offset pin between two rotational limits.

16. The apparatus of claim 11, wherein when the coupling assembly is in the default orientation, operation of the motor to enable latch retraction rotates the carousel and pin into a position that pivots the spring coupler into a position that urges the stopper into the unlocking position.

* * * * *